US006431680B1

(12) United States Patent
Shinada

(10) Patent No.: US 6,431,680 B1
(45) Date of Patent: Aug. 13, 2002

(54) INK CARTRIDGE AND RECORDING APPARATUS

(75) Inventor: Satoshi Shinada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/571,331

(22) Filed: May 15, 2000

Related U.S. Application Data

(63) Continuation of application No. PCT/JP99/05002, filed on Sep. 13, 1999.

(30) Foreign Application Priority Data

Sep. 14, 1998 (JP) ..... 10-260052

(51) Int. Cl.[7] ..... B41J 2/01
(52) U.S. Cl. ..... 347/19; 347/23
(58) Field of Search ..... 347/19, 23

(56) References Cited

U.S. PATENT DOCUMENTS

| | | | | |
|---|---|---|---|---|
| 5,049,898 A | | 9/1991 | Arthur | 347/19 |
| 6,019,461 A | * | 2/2000 | Yoshimura et al. | 347/86 |
| 6,106,088 A | * | 8/2000 | Wafler | 347/7 |

FOREIGN PATENT DOCUMENTS

| | | | |
|---|---|---|---|
| EP | 0 854 043 A | 7/1998 | |
| FR | 2 744 391 A | 8/1997 | |
| JP | 4-250066 | 9/1992 | B41J/2/175 |
| JP | 4-275156 | 9/1992 | B41J/2/175 |
| JP | 5-169670 | 7/1993 | B41J/2/175 |
| JP | 6-320732 | 11/1994 | B41J/2/05 |
| JP | 8-248839 | 9/1996 | G03G/21/00 |
| JP | 11-240185 | 9/1999 | B41J/2/21 |

OTHER PUBLICATIONS

International Search Report.

* cited by examiner

*Primary Examiner*—Craig A. Hallacher
(74) *Attorney, Agent, or Firm*—Sughrue Mion, PLLC

(57) ABSTRACT

Data in memory means of an ink cartridge can be read, written and rewritten by a recording apparatus. When abnormality has occurred in the recording apparatus, the information can be notified to a user or the like based on the data stored in the memory means of the ink cartridge. Further, control means is provided, which reads, writes and rewrites the data stored in the memory means of the ink cartridge, and in case that abnormality such as print error has occurred in the recording apparatus, the information can be given to the user based on the data stored in the memory means of the ink cartridge.

56 Claims, 5 Drawing Sheets

INK CARTRIDGE AND RECORDING APPARATUS

CROSS-REFERENCE TO RELATED APPLICATIONS

This is a continuation application of International Application No. PCT/JP99/05002 filed on Sep. 13, 1999.

BACKGROUND OF THE INVENTION

The present invention relates to an ink cartridge capable of supplying ink to printing means of an ink jet recording apparatus such as an ink jet printer, and its recording apparatus.

This type of a conventional printing apparatus has been disclosed in, for example, JP-A-8-248839 (known example). The summary of this apparatus is that a component exchangeably mounted to the printing apparatus are provided with a memory of which data can be read, written, and rewritten by the printing apparatus.

In the known example, a recording method is changed based on data from the memory so as to effectively perform a printing operation.

However, in this known example, the data of the memory is utilized solely for the purpose of changing the recording method.

SUMMARY OF THE INVENTION

A first problem that the invention is to solve is to provide what can judge availability of an ink cartridge and compatibility thereof to the recording apparatus based on data of memory means provided to the ink cartridge and notify a user of them.

A second problem that the invention is to solve is to provide what can rapidly remove a cause of abnormal state such as print error in the recording apparatus.

A third problem that the invention is to solve is to provide what causes an user to precisely know a stable using state of the ink cartridge, a stable using state between the ink cartridge and the recording apparatus, etc. and to suitably adopt them.

The present disclosure relates to the subject matter contained in Japanese patent application No. Hei. 10-260052 (filed on Sep. 14, 1998), which is expressly incorporated herein by reference in its entirety.

DESCRIPTION OF THE PREFERRED EMBODIMENT

The detail of the invention will be described below based on the shown embodiment.

Figure 1:
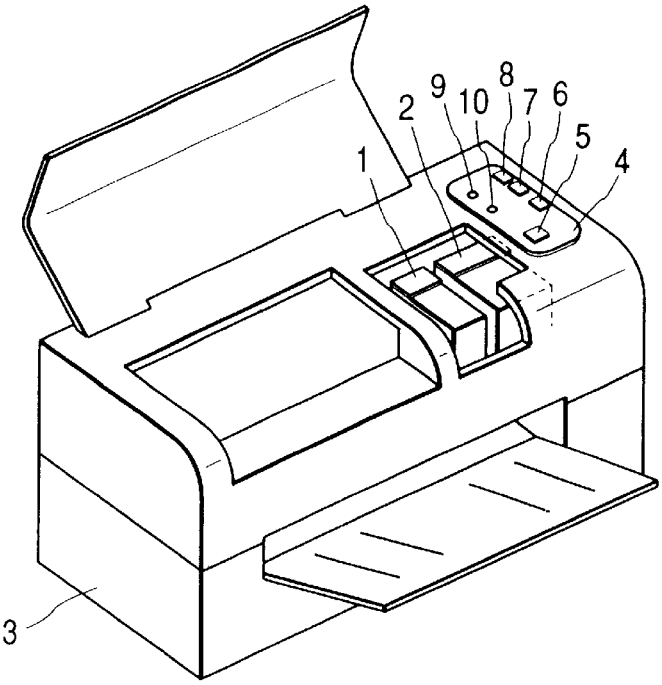
FIG. 1 is a diagram showing one embodiment of an ink jet recording apparatus of the present invention.

FIG. 1 shows one embodiment of an ink jet recording apparatus of the invention, in which ink cartridges 1 and 2 for supplying ink to a recording head are stored within a case 3.

On an exposed surface of the case 3, an operation panel 4 is provided, on which there are arranged a power switch 5, an ink cartridge exchanging instruction-switch 6, a black head cleaning instruction-switch 7, a color head cleaning instruction-switch 8, and displays 9,10 such as LEDs that are turned on and off or turned on when ink in a black cartridge and a color ink cartridge ends or an error occurs.

Figure 2:
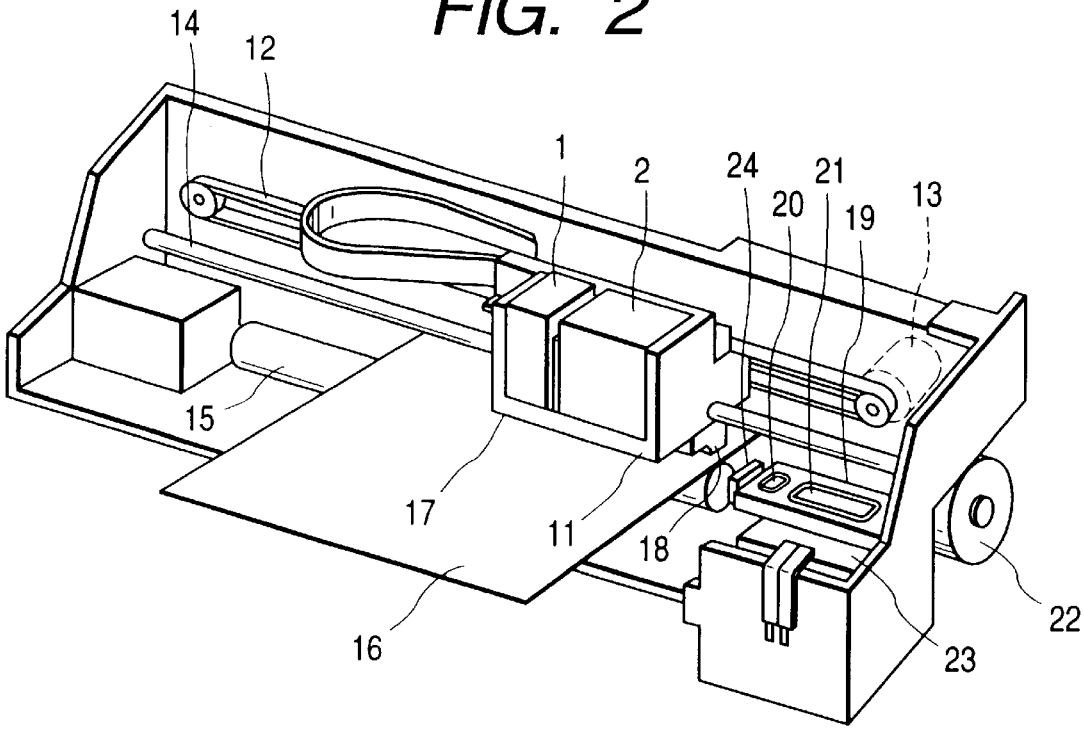
FIG. 2 is a diagram showing one embodiment of a recording mechanism of the ink jet recording apparatus of the invention.

FIG. 2 shows a summary of the printing mechanism. A carriage 11 is connected to a carriage driving motor 13 through a timing belt 12 and constructed so as to reciprocate in parallel with a platen 15 while being guide by a guide member 14. In the carriage 11, a recording head 17 which ejects black ink is fixed on a printing region side (in the figure, on the left side) of its surface opposite to a recording sheet 16, and a recording head 18 which ejects a color ink is fixed on non-printing region side (in the figure, on the right side) of the same.

A capping unit 19 disposed at the non-printing region is provided with a slider on which a cap 20 for sealing the black ink recording head 17 and a cap 21 for sealing the color ink recording head 18 are mounted, and each of the caps is connected through a tube to a duplex pump unit 23 which is driven by a motor 22, and constructed so as to individually receive supply of a negative pressure.

Each of the caps 20 and 21 is formed in the shape of a cup made of elastic material such as rubber having a size with which the nozzle opening surface of the associated recording head 17, 18 can be sealed by one space. These caps 20 and 21 are so designed that they can seal the nozzle opening surfaces of the recording heads 17 and 18 at the non-printing time and can cause the recording heads 17 and 18 to forcibly eject ink by the negative pressure from the pump unit 23 at the time of a recovery operation of ejecting capacity or at the time of exchange of the ink cartridges 7 and 8. Further, in the vicinity of the capping unit 19, a cleaning unit 24 is disposed, which brings a wiping blade into contact with the nozzle opening surfaces of the recording heads 17 and 18 by power from a driving source (not shown).

Figure 3A:
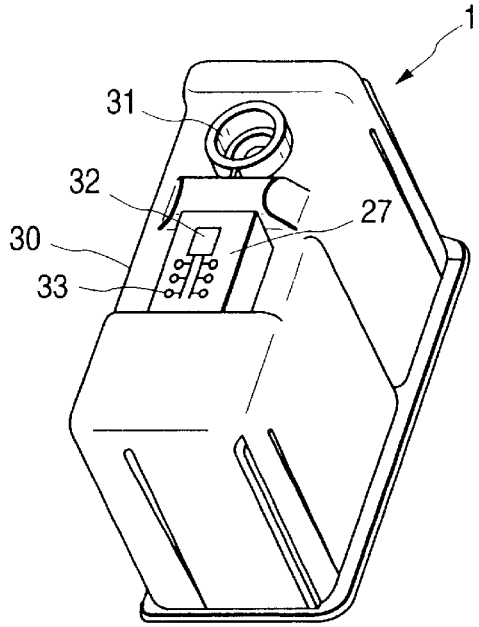
FIGS. 3A and 3B are diagrams each showing one embodiment of an ink cartridge used in the ink jet recording apparatus of the invention.
Figure 3B:
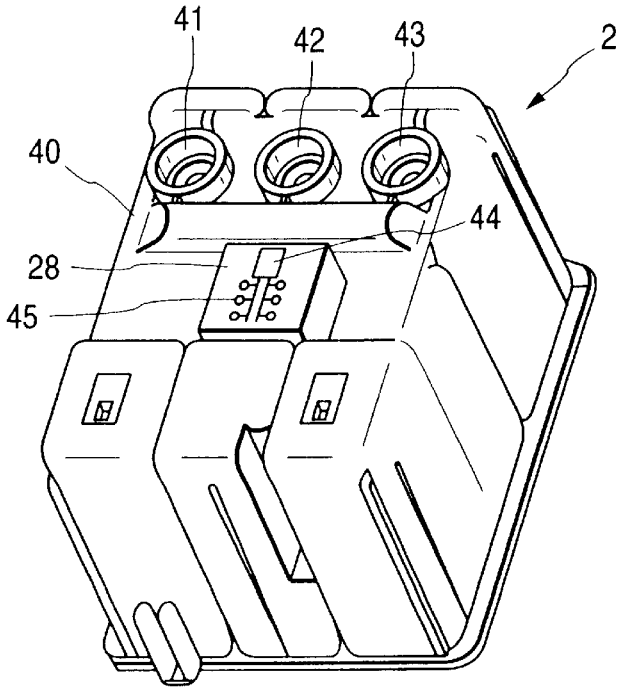

FIGS. 3A and 3B show one embodiment of the black ink cartridge 1 and one embodiment of the color ink cartridge 2, respectively. The black ink cartridge 1 has, on a surface thereof opposite to the carriage 11 when it is mounted on the carriage 11, in this embodiment, on a bottom surface 30 thereof, an ink supply port 31 connectable to an ink guide passage of the recording head 17, and memory means 32, such as EEPROM that is a rewritable nonvolatile memory.

The color ink cartridge 2 is divided into a plurality of rooms that store individually a plurality of color ink therein. On a bottom surface 40 of the color ink cartridge 2, there are provided ink supply ports 41, 42 and 43 which are communicated with respective ink chambers and can be connected to the ink guide passage of the recording head 18, and also memory means 44, such as EEPROM that is a rewritable nonvolatile memory.

These memory means 32 and 44 provided for the ink cartridges 1 and 2 are mounted on substrates 27 and 28, and connected to control means 53 to be described later through contacts 33 and 45 connected to said memory means 32 and 44 by contacts 34 and 46 formed at the carriage, so that data stored in these memory means 32 and 44 are read or data of the memory means in a main body of the recording apparatus is written.

Each memory means of the ink cartridges of the invention has at least the following data relating to the ink cartridge. As a data storage mode, data is stored with a data format that can be recognized by the recording apparatus main body or by a host computer connected to the recording apparatus.

(a) Kind of Data

Kind (type number) of ink cartridge (b) Recovery Data

Data at the time of the preceding recovery operation (c) Manufacturing Data

At least data of year and month when the ink cartridge has been manufactured is stored, and also data of date and time when the ink cartridge has been manufactured can be stored.

(d) Mounting Data

Figure 4:
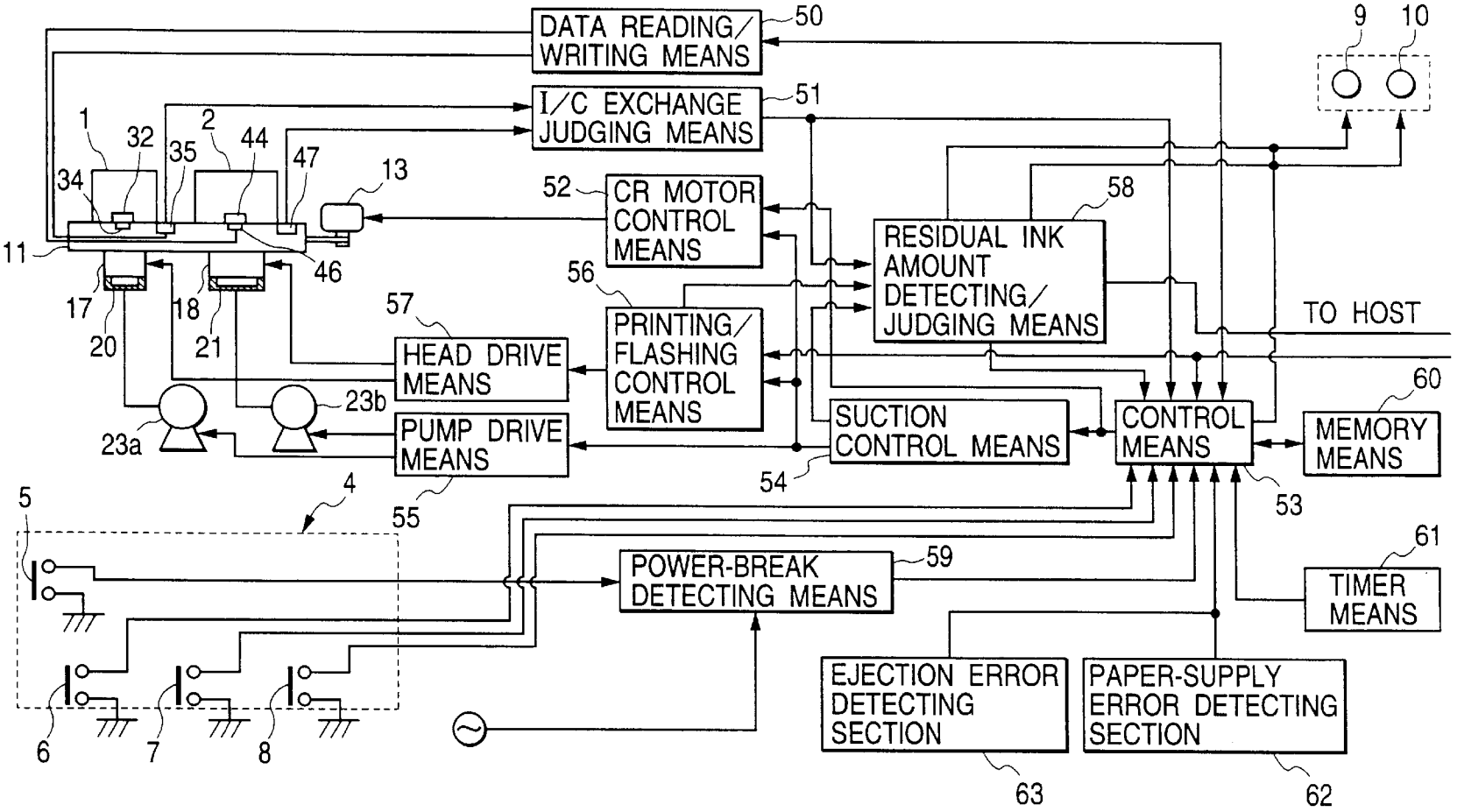
FIG. 4 is a constitutional view showing one embodiment of the ink jet recording apparatus of the invention.

Data of at least year and month when the ink cartridge has been mounted (e) Destination Data Destination data such as corresponding areas or corresponding countries of the ink cartridge FIG. 4 shows one embodiment of a controlling device of the recording apparatus. The control device is so designed that in a state where the contacts 34 and 46 of the carriage 11 are connected to the contacts 33 and 45 of the ink cartridges 1 and 2, data reading and writing means 50 read the data in the memory means 32 and 44 of the ink cartridges 1 and 2 or write the data of the memory means provided for a recording device to be described later into the memory means 32 and 44 of the ink cartridges 1 and 2.

Ink cartridge exchange judging means 51 receives signals from switches 35 and 47 that are located at positions of the carriage 11 opposite to the ink cartridges 1 and 2, in this embodiment on a cartridge receiving surface of the carriage 11, and that are push-operated by the ink cartridges 1 and 2, to thereby detect attachment and detachment of the ink cartridges 1 and 2.

Upon reception of control from the controlling means 53, carriage motor controlling means 52 causes the carriage 11 to reciprocate for printing and also causes the recording heads 17 and 18 to move to positions where the recording heads 17 and 18 can be capped at the time of the ejection recovering operation.

Upon reception of control from the controlling means 53, suction controlling means 54 causes the recording heads 17 and 18 to be sealed by the capping unit 19, and causes pump driving means 55 to control suction force of each suction pump 23*a*, 23*b* and suction time thereof thereby to forcibly eject ink from the recording heads 17 and 18 for the purpose of recovery of ink ejecting capacity. Further, when the ink cartridges 1 and 2 are exchanged, the suction controlling means 54 fills ink into the recording heads 17 and 18 from the ink cartridges 1 and 2 so that the printing operation can be performed.

Printing/flashing control means 56 causes head driving means 57 to output driving signals for ejecting ink droplets to each of the recording heads 17 and 18 based on the print data from the host, thereby to execute printing. Further, when each of recording heads 17 and 18 is located at a flashing position (for example, a position opposite to the cap), the means 56 causes the ink droplets to be ejected from all of nozzle openings by outputting the similar driving signals as the aforesaid signals, so that the viscosity-increased ink is ejected to the cap serving as an ink reception member.

Residual ink amount detecting means 58 adds up the number of dots formed by the printing operation, the number of the ink droplets ejected by the flashing operation, and the amount of ink consumed by the filling operation and the cleaning operation to calculate the amount of the residual ink in the ink cartridges 1 and 2.

Power-break detecting means 59 detects on/off of the power switch 5 and outputs signals indicative of that state. Further, when a power-off operation is performed, after the predetermined following operations have been executed, the means 59 stops power-supply to the apparatus.

The control means 53 receives signals from the ink cartridge exchanging instruction-switch 6 of the panel 4, the cleaning instruction switches 7 and 8 of the panel 4, the power-break detecting means 59, the residual ink amount detecting means 58 and the host, and generalizes operations, such as a power-on operation, a power-off operation, a cleaning operation, a residual ink amount checking operation, a printing operation and an ink cartridge exchanging operation. Further, the control means 53 stores, in the memory means 63, various statuses associated with the exchange of the ink cartridge at the time of the power-off operation. Moreover, the control means 53 receives signals from a paper-supply error detecting section 62 for detecting paper-supply error such as paper-jam, and an ejection error detecting section 63 for detecting ejection error of ink droplets, and performs an error displaying operation.

This ink cartridge 1, 2 and the recording apparatus aim to continue the high quality recording operation of a high quality by supplying the optimum ink from the ink cartridge 1, 2 mounted in the recording apparatus to the recording apparatus, and are featured in that, when a problem such as the print error occurs, the recording apparatus reads data of the recording means 32, 44 of the ink cartridge 1, 2, and informs an operator of a main cause of the problem to promote the execution of the corresponding countermeasures.

Figure 5:
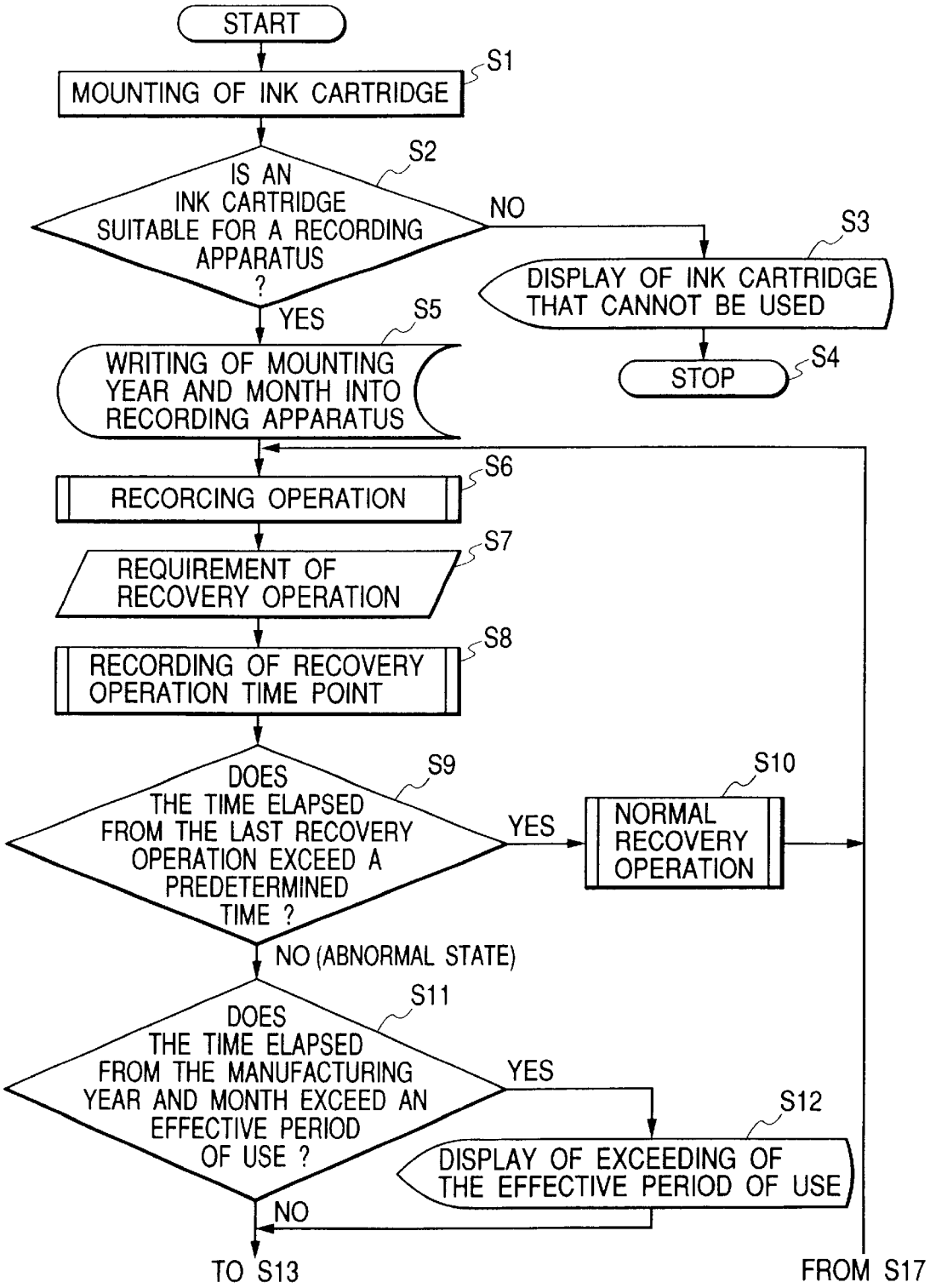
FIGS. 5 and 6 are flowcharts according to a first aspect of the invention.
Figure 6:
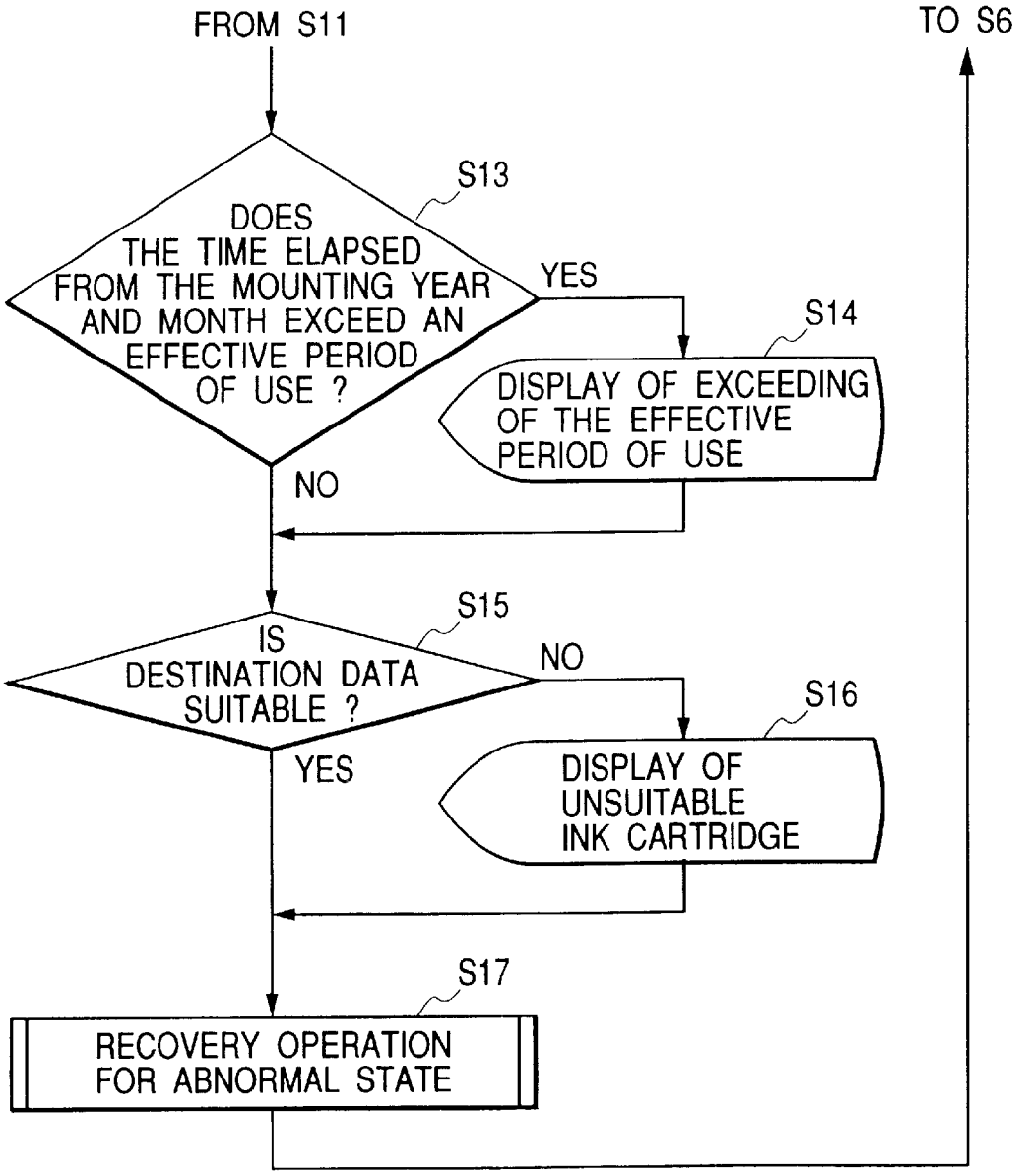

Next, operations of this ink cartridge and recording apparatus will be described with reference to flowcharts shown in FIGS. 5 and 6.

The ink cartridges 1, 2 are mounted on the carriage 11 serving as a mounting portion of the recording apparatus, and the ink supplying portions 31, 41, 42, 43 are communicated with the recording heads 17, 18 to enter a stand-by state for ink supply (S1).

In this state, the memory means 32, 44 are connected to respective contact portions 34, 46 of the recording apparatus so that the kind data (c) of the data stored in the memory means 32, 44 is read-out by the data reading and writing means 50, and compared by the control means 53 with the designated ink cartridge data retrieved from the memory means 60, whereby compatibility of the ink cartridges 1, 2 to the recording apparatus is judged (S2). If the ink cartridge 1, 2 is not compatible to the recording apparatus, the incompatibility is displayed in the displays 9, to give an alarm to the operator (S3), and a starting operation of the recording apparatus is restrained (S4).

If it is judged that the ink cartridge 1, 2 is compatible to the recording apparatus, the date data is recorded in the memory means 60 (S5), and when a recording instruction is given by operation means (not shown), ink supplied from ink storage portion of the ink cartridge 1, 2 is supplied from the ink supplying portion to the recording head portion, whereby the desired recording operation is executed (S6).

Next, when the operator requires the recovery operation of the recording head according to the necessity as the recording operation processes (S7), the recording apparatus records, in the memory means 60, time point at which the recovery operation such as a suction operation for sucking ink from the recording head has been performed (S8).

After the recording operation has been thus executed suitably, the control section 53 calculates elapsed time based on time data of a timer means 61 and the recovery operation time point data of the memory means 60, and compares the elapsed time with standard recovery interval data of the memory means 60 (S9). In case that a predetermined time elapses, a normal recovery operation (S10) is executed, while in case that the predetermined time does not elapse, the data reading and writing means 50 reads out data of the manufacturing date from the memory means 32, 44 and retrieves data of an effective period of use from the memory means 60 so that the control section 53 judges whether the effective period of use has been passed (S11). If passed, the display sections 9, 10 display the passing of the effective period of use (S12), and then the procedure proceeds to step S13.

Sequentially, mounting data is retrieved from the memory means 60 and compared with time point data of the timer 61 by the control section 53 (S13).

As a consequence of this comparison, if the time elapsed from the mounting date exceeds the effective period of use, the display sections 9, 10 display similarly the passing of the effective period of use (S14) and then the procedure proceeds to a step S15.

Next, destination data corresponding to this ink cartridge 1, 2 is read out by the data reading and writing means 50 from the memory means 32, 44, and compared with the designated ink cartridge data of the recording means 60 by the control section 53 (S15). In case that the destination data is not compatible to the designated ink cartridge data, the display sections 9, 10 display the incompatibility (S16).

Then, the recovery operation for abnormal state is executed (S17), and the procedure returns to the recording operation (S6).

All of the elapsed time data confirmed by the recording apparatus (S9, S11 and S13) during this procedure is-informed of the memory means 32, 44 of the ink cartridge 1, 2 by the data reading and writing means 50, and stored in the ink cartridges 1, 2 in a rewritten manner, so as to be effectively used in future recycling of the ink cartridge.

According to this ink cartridge and recording apparatus described above, a main cause of abnormal state which continuously requires the recovery operation is precisely informed of the operator by the display section, so that the operator can rapidly and correctly execute the operation for solving the problem.

Further, the effective countermeasure as described above makes it possible to eliminate operation error and damage of the recording apparatus caused by the ink cartridge.

As the display means, the display members 9 and 10 disposed in the case 3 are used, however, the indication and the alarm may be conducted on a host computer connected to the recording apparatus. In this case, more detailed data can be displayed than that in the display member of the recording apparatus, and can be also informed by voice.

As another informing method, the data to be informed may be printed on a paper medium. This method can be utilized in case that there is no display member, and even in case that there is a display member, this method can inform more detailed data.

Further, the informed data is stored in the memory means 60 of the recording apparatus for a predetermined period, whereby it can be utilized as the data for exchanging the cartridge by taking out the stored data according to the circumstances.

Further, a recording apparatus using an on-carriage type ink cartridge, which mounts an ink cartridge on a carriage, has been described as a recording apparatus. However, the invention can be applied to a recording apparatus using an off-carriage type ink cartridge, in which an ink cartridge is attached to a main body, i.e. a portion other than a carriage, of the apparatus, and ink is supplied to a recording head by a tube.

Effects of the above-described invention is as follows:

A main cause of problem on the recording operation due to the ink cartridge mounted on the recording apparatus can be recognized precisely, so that the corresponding operation for solving the problem can be rapidly executed.

Further, damage of the recording apparatus caused by the ink cartridge can be eliminated preliminarily.

What is claimed is:

1. A recording apparatus comprising:

an ink cartridge provided with memory means that stores data relating to the ink cartridge;

a recording head that performs a recording operation with ink supplied from the ink cartridge;

control means, which reads, writes and rewrites the data stored in the memory means of said ink cartridge, whereby when an abnormality has occurred in the recording apparatus, said control means generates abnormality information based on the data stored in the memory means of said ink cartridge, wherein said control means performs at least one of the following functions to create a notification of said abnormality: (1) instructs a host computer to generate a notification by outputting said abnormality information to said host computer and (2) instructs said recording head to record a notification based on said abnormality information.

2. The recording apparatus according to claim 1, wherein said data is indicative of a manufacturing year and a manufacturing month of the ink cartridge; a period elapsed from said manufacturing year and manufacturing month is calculated in case that the abnormality has occurred in the recording apparatus; and in case that the elapsed period exceeds an effective period of use, the information that the elapsed period exceeds the effective period of use can be notified.

3. The recording apparatus according to claim 1, wherein said data is indicative of a kind of the ink cartridge; whether or not said data indicative of the kind of ink cartridge can be used in the recording apparatus is judged; and in case that it cannot be used, an operation of the recording apparatus is stopped and the information that the ink cartridge cannot be used can be notified.

4. A recording apparatus, comprising:

an ink cartridge provided with memory means that stores data relating to the ink cartridge;

a recording head that performs a recording operation with ink supplied from the ink cartridge;

control means, which reads, writes and rewrites the data stored in the memory means of said ink cartridge, whereby when an abnormality has occurred in the recording apparatus, information can be notified based on the data stored in the memory means of said ink cartridge, wherein said data is indicative of a mounting year and a mounting month of the ink cartridge which the recording apparatus wrote in the memory means of the ink cartridge when the ink cartridge was mounted to the recording apparatus; a period elapsed from said mounting year and mounting month is calculated in case that the abnormality has occurred in the recording apparatus; and in case that the elapsed period exceeds an effective period of use, the information that the elapsed period exceeds an effective period of use can be notified.

5. A recording apparatus, comprising:

an ink cartridge provided with memory means that stores data relating to the ink cartridge;

a recording head that performs a recording operation with ink supplied from the ink cartridge;

control means, which reads, writes and rewrites the data stored in the memory means of said ink cartridge, whereby when an abnormality has occurred in the recording apparatus, information can be notified based on the data stored in the memory means of said ink cartridge, wherein said data is indicative of a destination of the ink cartridge; whether or not said data indicative of the destination of the ink cartridge is suitable for the recording apparatus is judged in case that abnormality has occurred in the recording apparatus; and in case that it is not suitable, the information that the ink cartridge is not suitable for use with the recording apparatus can be notified to a user.

6. An ink cartridge which stores ink to be supplied to a recording apparatus therein and includes memory means in which data relating to the ink cartridge is stored, wherein said memory means can be read, written and rewritten by the recording apparatus, and can transmit the data stored in the memory means to the recording apparatus when abnormality occurs in said recording apparatus, and wherein said data is indicative of a year and month when the ink cartridge was mounted to the recording apparatus.

7. The ink cartridge according to claim 6, wherein said data is indicative of a manufacturing year and month of the ink cartridge.

8. The ink cartridge according to claim 6, wherein said data is indicative of a kind of the ink cartridge.

9. An ink cartridge which stores ink to be supplied to a recording apparatus therein and includes memory means in which data relating to the ink cartridge is stored, wherein said memory means can be read, written and rewritten by the recording apparatus, and can transmit the data stored in the memory means to the recording apparatus when abnormality occurs in said recording apparatus, and wherein said data is indicative of a destination of the ink cartridge.

10. A method of controlling maintenance operation for a recording head to which ink is supplied from an ink cartridge that has a first memory system and that is removably mounted to a recording apparatus having the recording head and a second memory system, said method comprising the steps of:

preparing a first ejection operation for a normal state and a second ejection operation for an abnormal state;

calculating an elapsed time period from a time point at which one of said first and second ejection operation was carried out the latest to a time point at which an ejection operation is requested, using data stored in said first memory system and/or said second memory system;

comparing the elapsed time period with a predetermined interval;

executing said first ejection operation if the elapsed time period is equal to or more than the predetermined interval; and notifying a user of abnormal state information, and executing said second ejection operation if the elapsed time period is less than the predetermined interval.

11. A method according to claim 10, wherein said step of notifying and executing includes:

judging, based on data stored in said first memory system and/or said second memory system, whether or nor an effective use period has been passed from a manufacturing date of the ink cartridge;

notifying the user of an expiration of the period if it is judged that the period has been passed.

12. A method according to claim 10, wherein said step of notifying and executing includes:

judging, based on data stored in said first memory system and/or said second memory system, whether or not an effective use period has been passed from a time point at which said ink cartridge was first mounted to said recording device;

notifying the user of an expiration of the period if it is judged that the period has been passed.

13. A method according to claim 10, wherein said step of notifying and executing includes:

comparing first data that is indicative of destination of the ink cartridge and that is stored in said first memory system with second data stored in said second memory;

notifying the user of an incompatibility of the ink cartridge to the recording apparatus if the first data does not match the second data.

14. A method of controlling a recording apparatus comprising an ink cartridge containing an ink cartridge memory, comprising:

(a) determining that a recovery operation needs to be performed;

(b) reading data from said ink cartridge memory relating to a previous recovery operation;

(c) determining if said recovery operation to be performed is a normal recovery operation or an abnormal recovery operation based on said data read from said ink cartridge memory;

(d) performing said normal recovery operation if said recovery operation to be performed is determined to be said normal recovery operation; and (e) performing said abnormal recovery operation if said recovery operation to be performed is determined to be said abnormal recovery operation.

15. The method as claimed in claim 14, wherein said data comprises time data indicating a previous time that said previous recovery operation was performed, and wherein said operation (c) comprises:

(c1) determining said recovery operation to be performed is said normal recovery operation if an elapsed time since said previous time of said previous recovery operation is greater than a predetermined time; and (c2) determining said recovery operation to be performed is said abnormal recovery operation if said elapsed time since said previous time of said previous recovery operation is less than said predetermined time.

16. The method as claimed in claim 15, wherein said operation (a) comprises:

(a1) determining that said recovery operation needs to be performed; and (a2) writing data corresponding to a current time of said recovery operation in said memory.

17. The method as claimed in claim 16, wherein said elapsed time corresponds to a difference between said current time and said previous time.

18. The method as claimed in claim 14, wherein said data in said ink cartridge memory comprises manufacturing date data corresponding to a manufacturing date of said ink cartridge, and wherein said operation (e) comprises:

(e1) determining if an elapsed time since said manufacturing date exceeds a predetermined time if said recovery operation to be performed is determined to be said abnormal recovery operation;

(e2) generating a corresponding notification if said elapsed time exceeds said predetermined time if said recovery operation to be performed is determined to be said abnormal recovery operation; and (e3) performing said abnormal recovery operation if said recovery operation to be performed is determined to be said abnormal recovery operation.

19. The method as claimed in claim 14, wherein said data in said ink cartridge memory comprises mounting date data corresponding to a date on which said ink cartridge is mounted to said recording apparatus, and wherein said operation (e) comprises:

(e1) determining if an elapsed time since said mounting date exceeds a predetermined time if said recovery operation to be performed is determined to be said abnormal recovery operation;

(e2) generating a corresponding notification if said elapsed time exceeds said predetermined time if said recovery operation to be performed is determined to be said abnormal recovery operation; and (e3) performing said abnormal recovery operation if said recovery operation to be performed is determined to be said abnormal recovery operation.

20. The method as claimed in claim 14, wherein said data in said ink cartridge memory comprises destination data corresponding to a destination of sale of said ink cartridge, and wherein said operation (e) comprises:

(e1) determining if said destination data corresponds to a proper destination if said recovery operation to be performed is determined to be said abnormal recovery operation;

(e2) generating a corresponding notification if said destination data is not proper if said recovery operation to be performed is determined to be said abnormal recovery operation; and (e3) performing said abnormal recovery operation if said recovery operation to be performed is determined to be said abnormal recovery operation.

21. A recording apparatus, comprising:

an ink cartridge containing an ink cartridge memory; and a controller, wherein said controller determines that a recovery operation needs to be performed, wherein said controller reads data from said ink cartridge memory relating to a previous recovery operation, wherein said controller determines if said recovery operation to be performed is a normal recovery operation or an abnormal recovery operation based on said data read from said ink cartridge memory, wherein said controller instructs said normal recovery operation to be performed if said recovery operation to be performed is determined to be said normal recovery operation, and wherein said controller instructs said abnormal recovery operation to be performed if said recovery operation to be performed is determined to be said abnormal recovery operation.

22. The apparatus as claimed in claim 21, wherein said data comprises time data indicating a previous time that said previous recovery operation was performed, and wherein said controller determines that said recovery operation to be performed is said normal recovery operation if an elapsed time since said previous time of said previous recovery operation is greater than a predetermined time, and wherein said controller determines that said recovery operation to be performed is said abnormal recovery operation if said elapsed time since said previous time of said previous recovery operation is less than said predetermined time.

23. The apparatus as claimed in claim 22, wherein said controller writes data corresponding to a current time of said recovery operation in said memory when said recovery operation needs to be performed.

24. The apparatus as claimed in claim 23, wherein said elapsed time corresponds to a difference between said current time and said previous time.

25. The apparatus as claimed in claim 21, wherein said data in said ink cartridge memory comprises manufacturing date data corresponding to a manufacturing date of said ink cartridge, and wherein said controller determines if an elapsed time since said manufacturing date exceeds a predetermined time if said recovery operation to be performed is determined to be said abnormal recovery operation, wherein said controller generates a corresponding notification if said elapsed time exceeds said predetermined time if said recovery operation to be performed is determined to be said abnormal recovery operation, and wherein said controller instructs said abnormal recovery operation to be performed if said recovery operation to be performed is determined to be said abnormal recovery operation.

26. The apparatus as claimed in claim 21, wherein said data in said ink cartridge memory comprises mounting date data corresponding to a date on which said ink cartridge is mounted to said recording apparatus, and wherein said controller determines if an elapsed time since said mounting date exceeds a predetermined time if said recovery operation to be performed is determined to be said abnormal recovery operation, wherein said controller generates a corresponding notification if said elapsed time exceeds said predetermined time if said recovery operation to be performed is determined to be said abnormal recovery operation, and wherein said controller instructs said abnormal recovery operation to be performed if said recovery operation to be performed is determined to be said abnormal recovery operation.

27. The apparatus as claimed in claim 21, wherein said data in said ink cartridge memory comprises destination data corresponding to a destination of sale of said ink cartridge, and wherein said controller determines if said destination data corresponds to a proper destination if said recovery operation to be performed is determined to be said abnormal recovery operation, wherein said controller generates a corresponding notification if said destination data is not proper if said recovery operation to be performed is determined to be said abnormal recovery operation, and wherein said controller instructs said abnormal recovery operation to be performed if said recovery operation to be performed is determined to be said abnormal recovery operation.

28. A method of controlling a recording apparatus comprising an ink cartridge having an ink cartridge memory, comprising the steps of:

detecting a print error during printing;

judging whether or not the print error belongs to an abnormal state;

identifying a cause of the abnormal state using data stored in the ink cartridge memory if it is judged that the print error belongs to the abnormal state.

29. The method of claim 28, further comprising a step of:

notifying a user of the cause of the abnormal state to promote a corresponding countermeasure.

30. The method of claim 28, wherein:

said step of detecting includes receiving a recovery operation requirement.

31. The method of claim 30, wherein:

said step of judging includes judging whether or not a time interval between the recovery operation requirement and a previous recovery operation requirement is within a predetermined time period.

32. The method of claim 28, wherein:

said step of identifying includes judging whether or not an elapsed time since a manufacture date of the ink cartridge exceeds a predetermined time.

33. The method of claim 28, wherein:

said step of identifying includes judging whether or not an elapsed time since the ink cartridge is mounted to the printer exceeds a predetermined time.

34. The method of claim 28, wherein:

said step of identifying includes judging whether or not a designation of sale of the ink cartridge is proper.

35. The method of claim 28, wherein:

the steps of judging and identifying are executed using different data stored in the ink cartridge memory.

36. The method of claim 28, wherein:

the steps of judging and identifying are executed using data stored in the ink cartridge memory during use of the ink cartridge after manufacture thereof.

37. The method of claim 29, further comprising a step of:

executing an abnormal recovery operation after the cause of the abnormal state is identified.

38. A recording apparatus for use with an ink cartridge having an ink cartridge memory, comprising:

a controller that detects a print error during printing, that judges whether or not the print error belongs to an abnormal state, and that identifies a cause of the abnormal state using data stored in the ink cartridge memory if it is judged that the print error belongs to the abnormal state.

39. The apparatus of claim 38, wherein:

the controller issues an instruction signal for notifying a user of the cause of the abnormal state to promote a corresponding countermeasure.

40. The apparatus of claim 38, wherein:

the controller receives a recovery operation requirement to detect the print error.

41. The apparatus of claim 40, wherein:

the controller judges whether or not a time interval between the recovery operation requirement and a previous recovery operation requirement is within a predetermined time period.

42. The apparatus of claim 38, wherein:

the controller judges whether or not an elapsed time since a manufacture date of the ink cartridge exceeds a predetermined time.

43. The apparatus of claim 38, wherein:

the controller judges whether or not an elapsed time since the ink cartridge is mounted to the printer exceeds a predetermined time.

44. The apparatus of claim 38, wherein:

the controller judges whether or not a designation of sale of the ink cartridge is proper.

45. The apparatus of claim 38, wherein:

the controller reads data stored in the ink cartridge memory for judgment, and reads different data stored in the ink cartridge memory for identification.

46. The apparatus of claim 38, wherein:

the controller reads data stored in the ink cartridge memory during use of the ink cartridge after manufacture thereof, for judgment and identification.

47. The apparatus of claim 38, further comprising:

a system that executes an abnormal recovery operation after the cause of the abnormal state is identified.

48. A recording system for use with an ink cartridge having an ink cartridge memory:

a host computer;

a recording apparatus having a recording head, the recording apparatus being operatively connected to the host computer;

a controller installed in the recording apparatus and operatively connected to the host computer;

a memory storing a first programmed flow for normal operation and a second programmed flow branched from the first programmed flow for abnormal operation, wherein:

if the controller detects a print error when the first programmed flow is executed, the controller judges, based on data stored in the ink cartridge memory, whether or not the second programmed flow is activated in place of the first programmed flow.

49. The system according to claim 48, wherein:

the ink cartridge memory contains fixed item data stored at manufacture of the ink cartridge and has a memory area into which updateable data can be written or rewritten during use of the ink cartridge, and the controller judges the activation of the second programmed flow based on the updateable data.

50. The system according to claim 48, wherein:

the controller identifies a cause of the print failure using the second programmed flow.

51. The system according to claim 50, wherein:

the controller issues an instruction signal to at least one of the host computer and the recording head to notify a user of the cause of the print failure.

52. The system of claim 48, wherein:

the controller judges, based on data stored in the ink cartridge memory and using the second programmed flow, whether or not a time interval between the recovery operation requirement and a previous recovery operation requirement is within a predetermined time period.

53. The system of claim 48, wherein:

the controller judges, based on data stored in the ink cartridge memory and using the second programmed flow, whether or not an elapsed time since a manufacture date of the ink cartridge exceeds a predetermined time.

54. The apparatus of claim 48, wherein:

the controller judges, based on data stored in the ink cartridge memory and using the second programmed flow, whether or not an elapsed time since the ink cartridge is mounted to the printer exceeds a predetermined time.

55. The apparatus of claim 48, wherein:

the controller judges, based on data stored in the ink cartridge memory and using the second programmed flow, whether or not a designation of sale of the ink cartridge is proper.

56. The apparatus of claim 48, wherein:

the controller ends the second programmed flow after a abnormal recovery operation is executed, and then executes the first programmed flow again.

* * * * *